United States Patent [19]

Zook et al.

[11] Patent Number: 4,892,052

[45] Date of Patent: Jan. 9, 1990

[54] BOAT DECKING SYSTEM AND METHOD OF ASSEMBLING SAME

[75] Inventors: Eldon A. Zook, Churubusco; Leonard M. Niccum, Angola, both of Ind.

[73] Assignee: Harris-Kayot, Inc., Lagrange, Ind.

[21] Appl. No.: 189,995

[22] Filed: May 4, 1988

[51] Int. Cl.[4] ..... B63C 13/00

[52] U.S. Cl. ..... 114/85; 114/61; 114/355

[58] Field of Search ..... 114/61, 355, 356, 84, 114/85, 76

[56] References Cited

U.S. PATENT DOCUMENTS

| | | | |
|---|---|---|---|
| 2,975,747 | 3/1961 | Opie | 114/61 |
| 3,010,231 | 11/1961 | Matelich | 114/61 |
| 3,029,052 | 4/1962 | Early et al. | 114/26 |
| 3,246,349 | 4/1966 | Lyon | 9/6 |
| 3,465,486 | 9/1969 | Rolin | 114/356 |
| 3,889,619 | 6/1975 | Glassmeyer | 114/26 |
| 4,024,592 | 9/1977 | Schlagenhauf | 114/61 |
| 4,552,085 | 11/1985 | Eder et al. | 114/84 |
| 4,565,146 | 1/1986 | Koser et al. | 114/79 |
| 4,630,561 | 12/1986 | Franz et al. | 114/1 |
| 4,658,747 | 4/1987 | Franz et al. | 114/85 |

*Primary Examiner*—Joseph F. Peters, Jr.

*Assistant Examiner*—E. L. Swinehart

*Attorney, Agent, or Firm*—Jeffers, Hoffman & Niewyk

[57] ABSTRACT

A decking system for a boat includes a deck substructure composed of aluminum cross members attachable on pontoons of the boat, and elongated aluminum deck planks being attachable to the cross members of the deck substructure in side-by-side relation to one another and thereabove to provide a deck platform upon the deck substructure. The planks include a pair of planks at outer sides of the deck platform and a plurality of middle planks therebetween. Each outer side and middle plank has a main platform-forming portion with a pair of opposite longitudinal edges thereon and plank-supporting rail and runner portions depending adjacent the edges of the platform-forming portion. Tongue and chennel portions are defined along the respective edges to provide mating between adjacent ones of the planks. Each rail portion has a flange disposed outwardly of one edge of the platform-forming portion and exposed from thereabove such that the middle planks are assemblable together one at a time progressing from one side of the deck substructure to the other side thereof alternately with attachment of the middle planks via the flanges to the deck substructure from above the substructure.

23 Claims, 2 Drawing Sheets

BOAT DECKING SYSTEM AND METHOD OF ASSEMBLING SAME

BACKGROUND OF THE INVENTION

The present invention generally relates to boat deck construction and, more particularly, is concerned with an improved boat decking system and method of assembling the decking system.

Pontoon boats typically have a large deck supported on a pair of laterally spaced elongated pontoons which float on the water. The deck provides a spacious platform close to the surface of the water which makes it easy for a family or group of friends to enjoy a variety of recreational activities, such as pleasure cruising, entertaining, swimming, water skiing, sunning and scuba diving.

Historically, the decks of pontoon boats have been made of sheets of wood, such as plywood, screwed to a substructure of cross members, such as aluminum channels, which in turn are bolted to aluminum pontoons. One disadvantage of wood decks is that they deteriorate over time and must be painted or otherwise preserved to avoid the deleterious effects of water. One particular problem area is the region between the plywood deck platform and the cross members which tends to trap water, thereby promoting rotting of the wood. Another disadvantage of wood decks is found in their customary mode of assembly. Typically, holes are drilled through the cross members and then screws are installed from underneath to attach the wood sheets thereto. This is a cumbersome and difficult procedure.

One approach to eliminating the problems associated with wood decks is to use aluminum instead of wood. One aluminum decking system known in the prior art includes a plurality of elongate aluminum planks mounted in longitudinally extending, side-by-side relation on a substructure of longitudinally spaced aluminum cross members. Each plank has grooves on the upper side of its main platform-forming portion into which glue is applied for adhering carpet to the platform formed by the planks. Each plank has a pair of nestable spaced J-shaped support runner portions depending from along opposite longitudinal edges of the main platform-forming portion of the plank.

However, a significant disadvantage still resides in this all-aluminum decking system. The above-described plank configuration requires that the screws used to attach the runner portions of the planks to the cross members still be inserted from underneath the decking system, as customary in assembling the wood deck. As before, this necessitates a very difficult procedure for properly assembling the planks to the substructure.

Consequently, there exists a need for an improved decking system and method of assembly which will avoid the above mentioned problems.

SUMMARY OF THE INVENTION

The present invention provides a boat decking system and assembling method designed to satisfy the aforementioned needs. The decking system of the present invention incorporates several improved features which make the deck planks easy to assemble from above the deck substructure, hold tightly together the assembled planks so as to prevent them from rattling, and allow assembling and storage of decking systems as subassemblies for later attachment to pontoons when needed to complete assembly of the boats.

One feature relates to the provision of a plurality of long aluminum or galvanized steel deck planks that are fastened to a deck substructure of cross members by welding, crimping, self-tapping screws or other types of fasteners. Each of the planks has a main elongated platform-forming portion and a plank-supporting rail portion depending along one longitudinal edge of the platform-forming portion. An upwardly-facing longitudinal groove may be formed in a bottom flange of the rail portion and extends the length of the plank to assist in starting penetration of the self-tapping screws. The groove-bearing bottom flange projects from the rail portion outwardly away from the main platform forming portion of the plank so that the flange is exposed from above and thus the attaching screws or other fastening means can be applied from above the deck substructure.

Another feature relates to employment of matable tongue and channel portions by adjacent ones of the planks for allowing easy assembling of the planks to provide the deck platform. The planks are assembled together one at a time progressing from one side of the deck substructure to the other alternately with installation of screws in the rail portion bottom flange of each plank.

Still another feature relates to the provision of longitudinal ridges on the tongue portions of planks. The combined height of the ridge and thickness of the tongue portion is slightly greater than the height of the channel portion. Thus, when the tongue portion of one plank is inserted into the channel portion of the adjacent plank which is already attached to the deck substructure, the ridge on the tongue portion deforms slightly by flattening to prevent occurrence of rattling between the tongue and channel portions.

Accordingly, the present invention is directed to a boat decking system which comprises a deck substructure and a multiplicity of elongated deck planks being attachable to the deck substructure in adjacent side-by-side relation to one another and above the deck substructure to provide a deck platform upon the deck substructure. The planks include a plurality of middle planks each having a main elongated platform-forming portion with a pair of opposite longitudinal edges thereon, a plank-supporting rail portion depending adjacent one edge of the platform-forming portion, a plank-supporting runner portion depending adjacent the other edge thereof, and attaching means defined along the edges thereof and being matable with attaching means on edges of adjacent one of the middle planks.

More particularly, the rail portion of each middle plank has anchoring means thereon being disposed outwardly of one edge of the platform-forming portion and exposed from thereabove. Thus, the middle planks are assemblable together one at a time progressing from one side of the deck substructure to the other side thereof alternately with attachment of the middle planks via their anchoring means thereon to the deck substructure from above the substructure. The deck substructure is preferably composed of a plurality of aluminum cross members, whereas the planks are preferably aluminum planks. However, other rust resistant materials, such as galvanized steel, can be used.

Further, the attaching means includes a channel portion defined along one edge of the platform-forming portion and a tongue portion defined along the other edge thereof and being sized to insert within the channel portion. Also, each of the tongue portions has a longitudinal ridge or protrusion formed thereon. The combined height of the ridge and thickness of the tongue portion is slightly greater than the height of the channel portion whereby when the tongue portion of one middle plank is inserted into the channel portion of an adjacent middle plank, the ridge on the tongue portion deforms to provide a tight fit which prevents occurrence of rattling between the tongue and channel portions of adjacent middle planks.

Still further, the anchoring means on the middle plank rail portion is a bottom flange disposed below and projecting outwardly away from one edge of the main platform-forming portion of the plank. The flange has an upwardly-facing longitudinal groove defined therein which extends the length of the middle plank and is adapted to assist in starting insertion of self-tapping screws through the flange and into the deck substructure for attaching the planks thereto.

Also, the present invention relates to a method of assembling a boat decking system, comprising the steps of: constructing a deck substructure, and placing a plurality of deck planks on the deck substructure in side-by-side relation to one another to provide a deck platform upon the deck substructure. The deck planks are placed on the deck substructure one at a time progressing from one side of the deck substructure to the other side thereof alternately with attachment of each plank to the deck substructure from above the substructure before the next plank is placed thereon. The deck substructure constructing step includes placing and attaching a plurality of cross members on pontoons in longitudinally spaced relation to one another.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
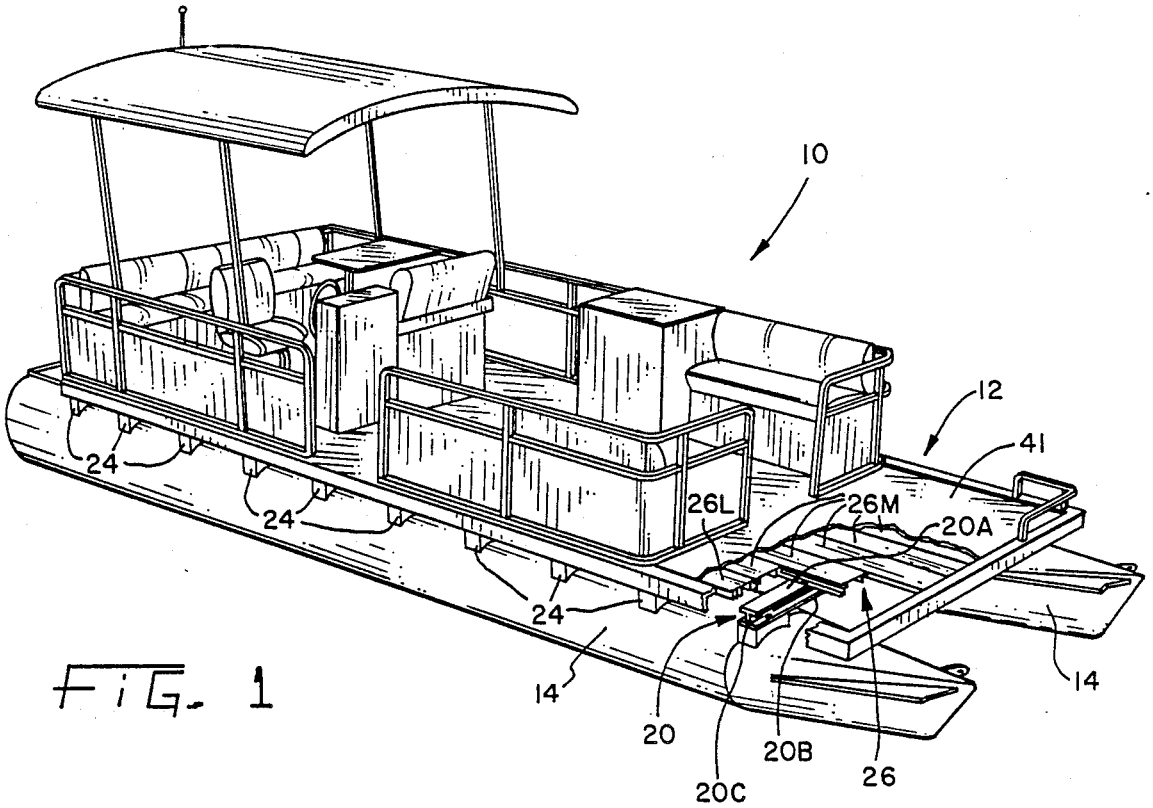
FIG. 1 is a perspective view, with portions broken away, of a pontoon boat having a decking assembly employing the features of the present invention.

Referring now to the drawings, and particularly to FIG. 1, there is shown a pontoon boat 10, which incorporates a decking system 12 constituting the preferred embodiment of the present invention. While the decking system 12 is shown installed on a boat having a pair of elongated cylindrical pontoons 14, it should be understood that the decking system 12 has application to other types of boats as well.

Figure 2:
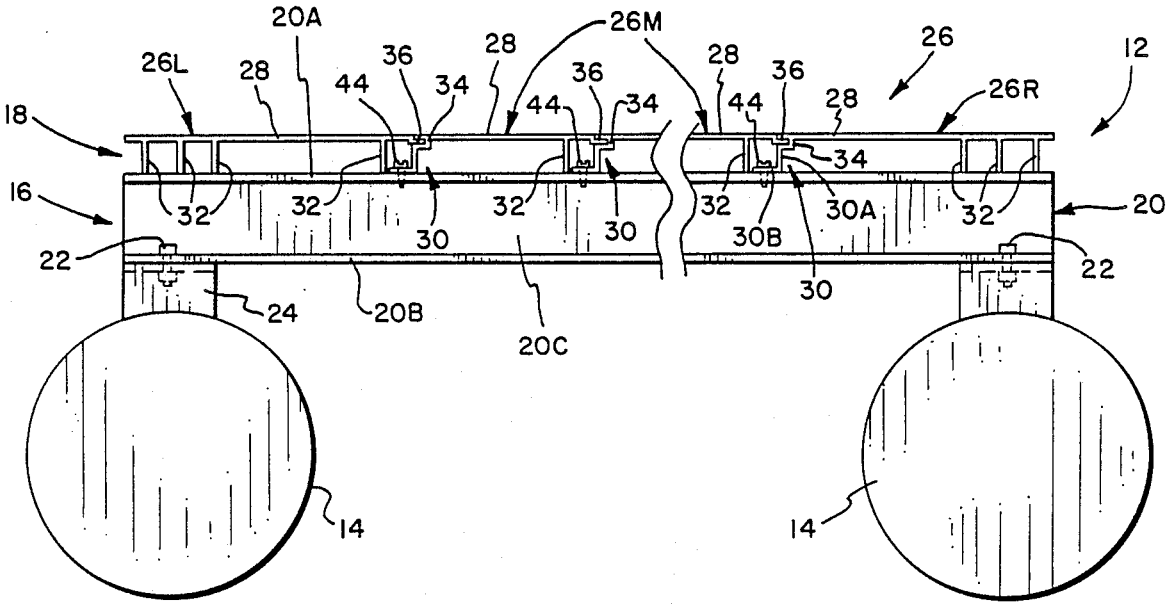
FIG. 2 is an enlarged cross sectional view of the decking system on the boat of FIG. 1.
Figure 3:
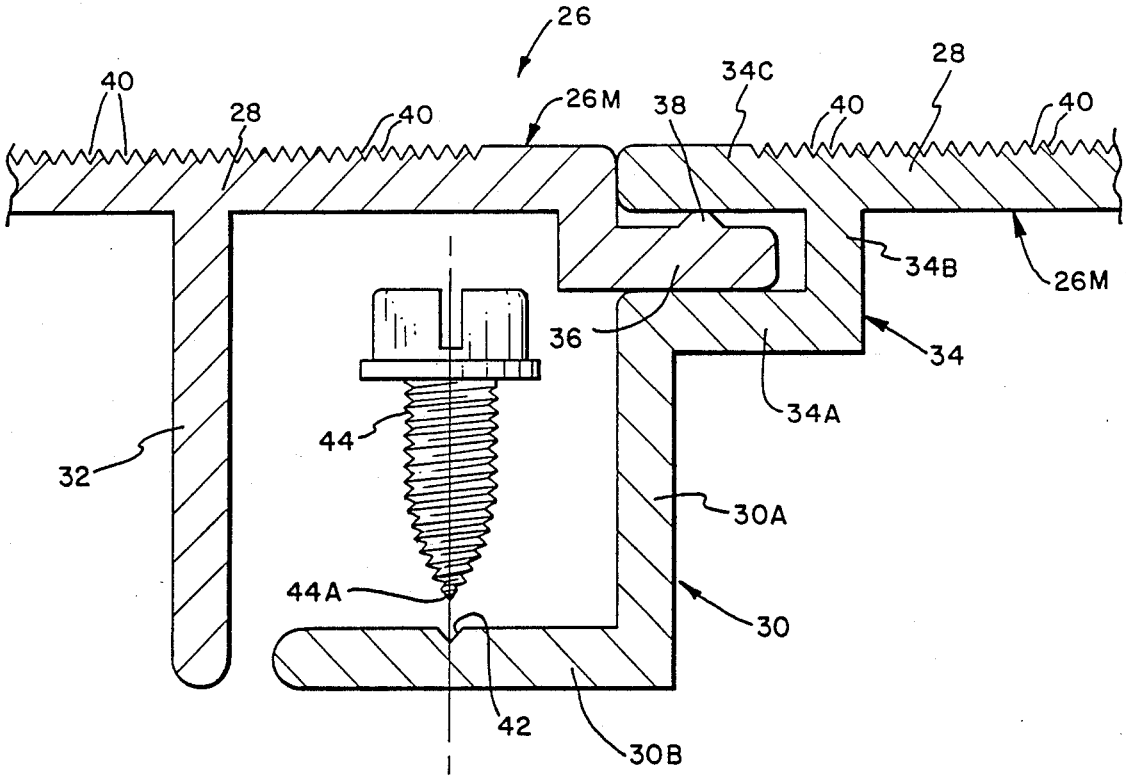
FIG. 3 is an enlarged view of a fragmentary portion of the decking system of FIG. 2.
Figure 4:
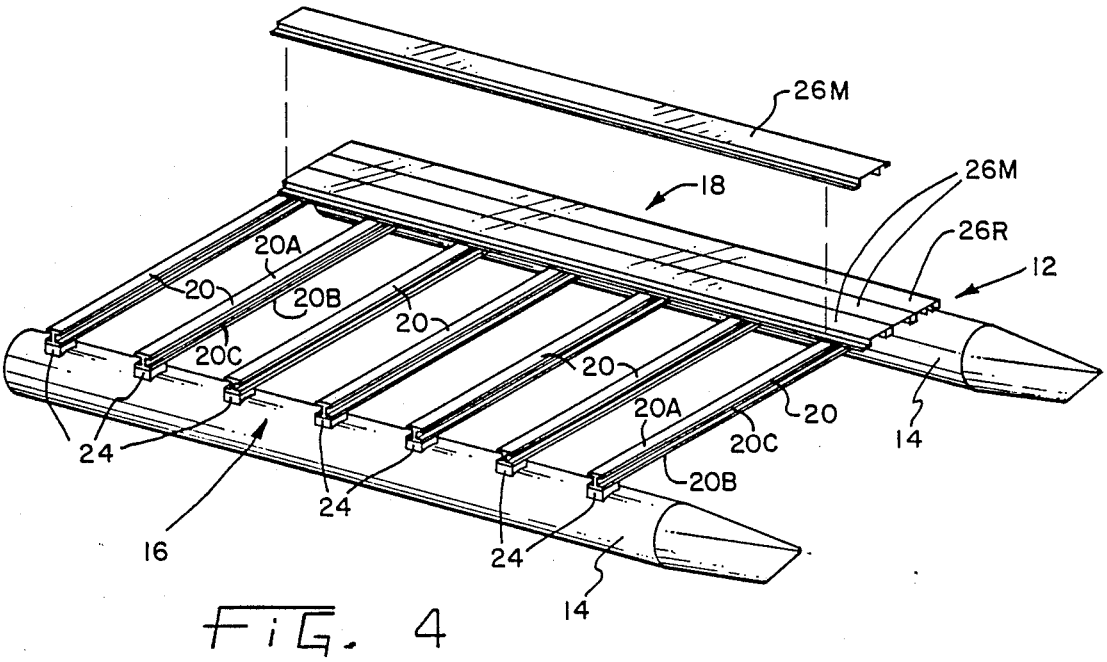
FIG. 4 is a perspective view depicting one method of assembling the decking system of FIG. 2.

Referring now to FIGS. 1 to 3, the decking system 12 basically includes a deck substructure 16, and a deck platform 18 disposed upon the deck substructure 16. The deck substructure 16 of the decking system 12 preferably is composed of a plurality of elongated aluminum cross members 20. Each cross member 20 includes upper and lower planar portions 20A, 20B and an intermediate planar portion 20C extending between and interconnecting the upper and lower portions 20A, 20B so as to dispose them in fore-and-aft offset relation but generally parallel to one another and in generally orthogonal relation to the intermediate portion 20C. The cross members 20 are attachable at their lower forward portions 20B by bolts 22 to mounting brackets 24 being fixed in longitudinally spaced relation to one another on the pontoons 14. When attached to the pontoon brackets 24 as seen in FIG. 4, the cross members 20 form an array in which they are spaced from one another longitudinally along the pontoons 14 and extend in generally orthogonal relation to the pontoons 14.

The deck platform 18 of the decking system 12 is composed of a multiplicity of elongated aluminum deck panels or planks 26 being attachable to the cross members 20 of the deck substructure 16 in adjacent side-by-side relation to one another and above the cross members 20. The deck planks 26 include a pair of planks 26L, 26R being disposed at opposite outer sides of the deck platform 18 and a plurality of intermediate or middle planks 26M disposed between the opposite outer side, or left and right hand, planks 26L, 26R. Each of the middle and outer side planks 26M, 26L, 26R have a main elongated platform-forming portion 28 with a pair of opposite longitudinal edges thereon.

Also, each middle plank 26M includes a plank-supporting rail portion 30 depending adjacent the left edge of the platform-forming portion 28 thereof and a plank-supporting runner portion 32 depending adjacent the right edge thereof. Further, attaching means in the form of a channel portion 34 is defined along the left edge of the platform-forming portion 28 and a tongue portion 36 is defined along the right edge thereof. The tongue portion 36 on one middle plank 26M is adapted to insert within the channel portion 34 on an adjacent middle plank.

The runner portion 32 of each middle plank 26M is in the form of a generally vertical planar strip being fixed and depending generally perpendicular to the underside of the plank platform-forming portion 28 inwardly from the tongue portion 36 defined by the right edge of the platform-forming portion 28. On the other hand, the rail portion 30 of each middle plank 26M is in the form of a generally vertical planar strip 30A and a horizontal planar bottom flange 30B integrally connected thereto and extending in orthogonal relation outwardly from the left edge of the platform-forming portion 28 of the middle plank 26M. The channel portion 34 has a U-shaped cross-sectional configuration and is connected at the outer end of its lower one leg 34A to the upper end of the vertical strip 30A of the rail portion 30 and at its base 34B to the left edge of the platform-forming portion 28 of the middle plank 26M which also constitutes the upper leg 34C of the channel portion 34. Thus, both the runner portion 32 and the vertical strip 30A of the rail portion 30 of each middle plank 26M extend in generally orthogonal relation to the platform-forming portion 28 thereof.

In addition, as seen in FIG. 3, each tongue portion 36 has a longitudinal ridge 38 formed thereon having a generally triangular cross-sectional shape before insertion of the tongue portion 36 into one of the channel portions 34. The combined height of the ridge 38 and thickness of the tongue portion 36 is slightly greater than the height of the channel portion 34. Thus, as the tongue portion 36 of one middle plank 26M is inserted into the channel portion 34 of an adjacent middle plank 26M as seen in FIG. 3, the ridge 38 on the tongue portion 36 flattens or deforms somewhat to provide a tight fit between the channel and tongue portions 34, 36 of the adjacent middle planks 26M. The tight fit prevents rattling. Also, each platform-forming portion 28 of the middle planks 26M has a plurality of longitudinal grooves 40 defined on the upper surface thereof for receiving glue to attach a carpet 41 on the upper surface of the deck platform 18, as depicted in FIG. 1.

The bottom horizontal flange 30B of the rail portion 30 of each middle plank 26M defines an anchoring means disposed outwardly of its channel portion 34 at the left edge of its platform-forming portion 28 so as to be exposed from above the plank. Thus, as depicted in FIG. 4, it is readily apparent that the middle planks can be assembled together one at a time by inserting the tongue portion 36 on a free plank into the groove portion 34 on a plank already attached to the cross members 20 of the deck substructure 16. Such assembling of the planks proceeds or progresses from the right side of the deck substructure 16 to the left side thereof, as viewed in FIG. 2, alternately with attachment of the middle planks 26M via their bottom flanges 30B to the deck substructure 16. It will be seen that exposure of the bottom flanges 30B facilitates attachment thereof to the cross members 20 from above the substructure 16. Attachment of the flange 30B to the cross members 20 is facilitated by the presence of an upwardly-facing longitudinal groove 42 defined in the flange 30B and extending the length of the plank. A plurality of self-tapping screws 44 are used to attach the flange 30B to the cross members 20. The pointed leading ends 44A of the screws 44 are sized to fit into the groove 42 from above the deck substructure 15 with the groove then providing an assist in starting penetration of the self-tapping screws 44 into the flange 30B.

Referring to FIG. 2, as mentioned earlier, each outer right and left side plank 26R, 26L has the main elongated platform-forming portion 28 with the pair of opposite longitudinal edges thereon. Also, the right side plank 26R has a plurality of spaced apart plank-supporting runner portions 32 fixed to and depending adjacent and below the right edge of its platform-forming portion 28 and a single plank-supporting rail portion 30 depending adjacent the left edge thereof. Further, the right side plank 26R has a groove portion 34 on its left edge adjacent the rail portion 30.

The left side plank 26L has a plurality of spaced apart plank-supporting runner portions 32 fixed to and depending adjacent and below the left edge of its platform-forming portion 28 and a single plank-supporting runner portion 32 fixed to and depending adjacent and below the right edge thereof. Further, the left side plank 26L has a tongue portion 36 on its right edge adjacent the one runner portion 32.

The channel portion 34 of the right side plank 26R receives the tongue portion 36 of the adjacent farthest right one of the middle planks 26M, whereas the tongue portion 36 of the left side plank 26L is received in the channel portion 34 of the adjacent farthest left one of the middle planks 26M. Rub rails (not shown) are attached to the right and left side planks 26R, 26L for anchoring them to the deck substructure 16.

In the method of assembling the decking system 12 illustrated in FIG. 4, it is seen that, first, the deck substructure 16 is constructed by placing and attaching the cross members 20 to the mounting brackets 24 located on the pontoons 14 in longitudinally spaced relation therealong. Then, the right side plank 26R is the first plank applied to the deck substructure 16 in assembling the deck platform 18. After the right side plank 26R is attached to the cross members 20 as seen in FIG. 2, the first middle plank 26M is then applied by slidably mating its tongue portion 36 into the channel portion 34 on the right side plank 26R and by attaching its flange 30B to the cross members 20. The other middle planks 26M are similarly applied in succession in side-by-side relation to one another and progressing from right to left, with the left side plank 26L being the last plank to be applied to the deck substructure 16 to complete construction of the deck platform 18 upon the substructure 16, with the substructure, in turn, attached upon the pontoons 14.

Figure 5:
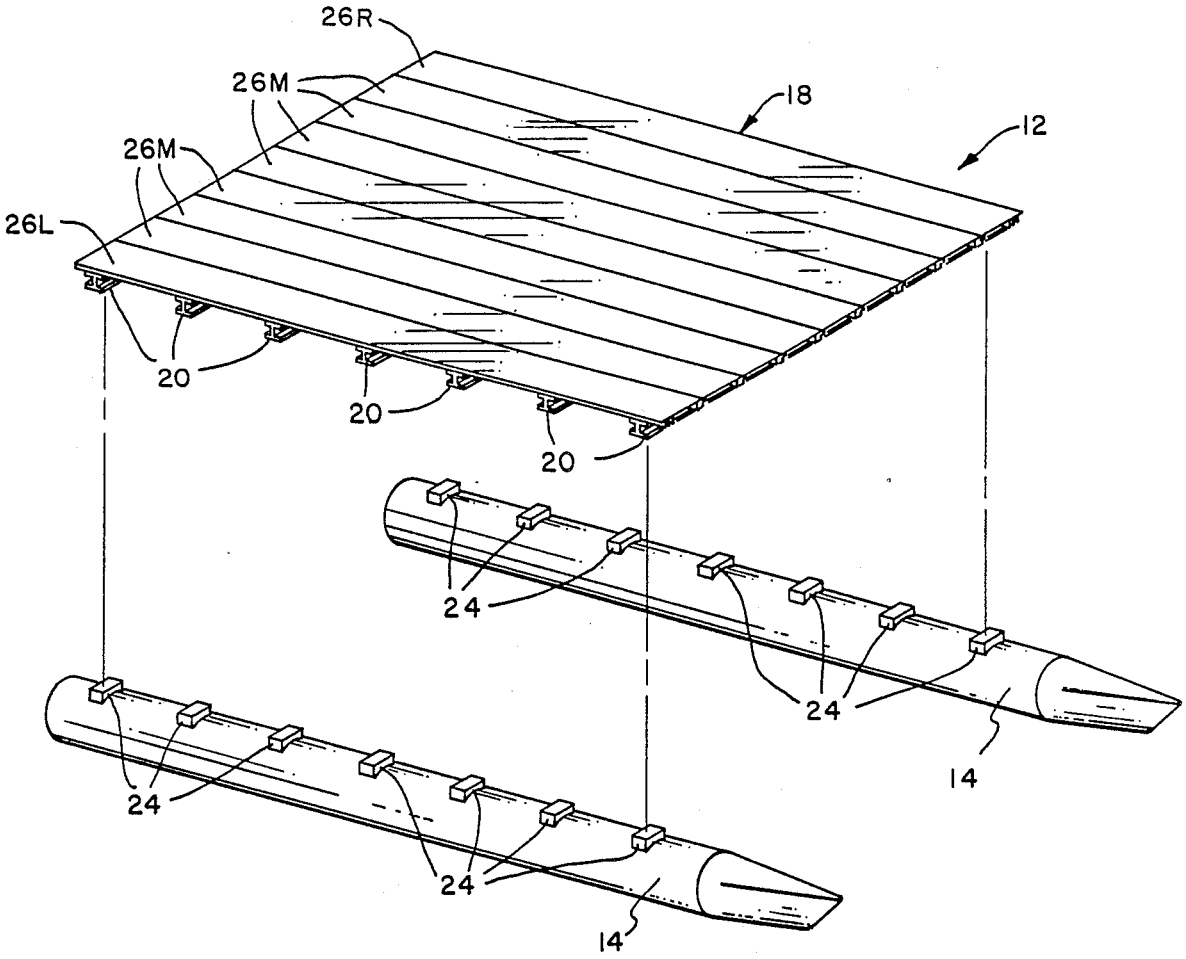
FIG. 5 is a perspective view depicting an alternative method of assembling the decking system of FIG. 2.

Alternatively, as seen in FIG. 5, a decking system 12 can be assembled before being mounted on the pontoons 14. This is the approach used when it is desired to assemble and store decking systems 12 and then only later mount them to pontoons as needed. It is much more convenient to store assembled decking systems 12 separate from the pontoons 14. In the latter method the deck substructure is constructed by laying out the cross members 20 in the longitudinally spaced relation they will have when mounted to the pontoons. Then, the planks 26 are mounted to the cross members 20 in the same manner as before and the deck system 12 is mounted to a pair of pontoons.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

WHAT IS CLAIMED IS:

1. A boat decking system comprising:

a deck substructure; and a multiplicity of elongate deck planks being attached to said deck substructure in adjacent side-by-side relation to one another and above said deck substructure to provide a deck platform upon said deck substructure;

said planks including a plurality of middle planks each having a main elongated platform-forming portion with a pair of opposite longitudinal edges thereon, a plank-supporting rail portion depending adjacent one said edge of said platform-forming portion, and attaching means defined along said edges thereof and being matable with attaching means on edges of adjacent ones of said middle planks;

said rail portion of each said middle plank having anchoring means thereon being disposed outwardly of said one edge of said platform-forming portion and exposed from thereabove such that said middle planks are assemblable together one at a time progressing from one side of said deck substructure to the other side thereof alternately with attachment of said middle planks via said anchoring means thereon to said deck substructure from above said substructure.

2. The decking system as recited in claim 1, wherein said deck substructure is composed of a plurality of aluminum cross members.

3. The decking system as recited in claim 1, wherein said planks are aluminum planks.

4. The decking system as recited in claim 1, wherein said attaching means includes a channel portion defined along one said edge of said platform-forming portion and a tongue portion defined along the other said edge thereof and being insertable within said channel portion.

5. The decking system as recited in claim 4, wherein each of said tongue portions has a longitudinal ridge formed thereon such that the combined height of said ridge and thickness of the tongue portion is slightly greater than the height of said channel portion whereby when said tongue portion of one middle plank is inserted into said channel portion of an adjacent middle plank, said ridge on said tongue portion deforms to provide a tight fit between said tongue and channel portions of said adjacent middle planks.

6. The decking system as recited in claim 1, wherein said anchoring means on said middle plank rail portion is a bottom flange disposed below and projecting outwardly away from one said edge of said main platform-forming portion thereof.

7. The decking system as recited in claim 6, wherein said flange has an upwardly-facing longitudinal groove defined therein which extends the length of said middle plank.

8. The decking system as recited in claim 7, further comprising:

a plurality of self-tapping screws adapted to be applied from above said deck substructure into said groove in said rail portion flange of each middle plank for attaching said flange to said substructure, said groove providing an assist in starting penetration of said self-tapping screws.

9. The decking system as recited in claim 1, wherein said planks include a pair of planks being disposed at opposite outer sides of said deck platform, each outer side plank having a main elongated platform-forming portion with a pair of opposite longitudinal edges thereon, one outer side plank having a plank-supporting runner portion depending adjacent one said edge of said platform-forming portion and a plank-supporting rail portion depending adjacent the other said edge thereof, the other outer side plank having plank-supporting runner portions depending adjacent both said edges thereof, one outer side plank having an attaching means defined along one said edge thereof and being matable with said attaching means of an adjacent one of said middle planks, and the other outer side plank having attaching means defined along the other said edge thereof and being matable with said attaching means of an adjacent one of said middle planks.

10. The decking system as recited in claim 1, wherein said rail and runner portions of each middle plank extend in generally orthogonal relation to said platform-forming portion thereof.

11. The decking system as recited in claim 1 wherein said attaching means includes a channel portion defined along one edge of said platform-forming portion and a tongue portion defined along the other said edge thereof, said tongue portion being insertable within said channel portion of an adjacent said plank, said attaching means further including protrusion means formed on one of said tongue portion or channel portion and providing an interference fit between said tongue and channel portions.

12. The decking system as recited in claim 1, wherein each of said middle planks includes a plank-supporting runner portion depending adjacent the other said edge of said middle plank.

13. A decking system for a pontoon boat, said decking system comprising:

a deck substructure composed of a plurality of aluminum cross members being attached to a plurality of pontoons of a boat;

a multiplicity of elongated aluminum deck planks attached to said cross members of said deck substructure in side-by-side relation to one another and above said cross members of said deck substructure to provide a deck platform upon said deck substructure;

said planks including a plurality of middle planks each having a main elongated platform-forming portion with a pair of opposite longitudinal edges thereon, a plank-supporting rail portion depending adjacent a first said edge of said platform-forming portion, a plank-supporting runner portion depending adjacent a second said edge thereof, a channel portion defined along one of said edges, and a tongue portion defined along the other of said edges, said channel and tongue portions being matable respectively with said tongue and channel portions on edges of adjacent ones of said middle planks;

said rail portion of each said middle plank having anchoring means thereon being disposed outwardly of one of said edges of said platform-forming portion and exposed from thereabove such that said middle planks are assemblable together one at a time progressing from one side of said deck substructure to the other side thereof alternately with the attachment of said middle planks via said anchoring means thereon to said deck substructure from above said substructure.

14. The decking system as recited in claim 13, wherein each of said tongue portions has a longitudinal ridge formed thereon such that the combined height of said ridge and thickness of the tongue portion is slightly greater than the height of said channel portion whereby when said tongue portion of one middle plank is inserted into said channel portion of an adjacent middle plank said ridge on said tongue portion deforms to provide a tight fit between said tongue and channel portions of said adjacent middle planks.

15. The decking system as recited in claim 13, wherein said anchoring means on said middle plank rail portion is a bottom flange disposed below and projecting outwardly away from said main platform-forming portion thereof.

16. The decking system as recited in claim 15, wherein said flange has an upwardly-facing longitudinal groove defined therein which extends the length of said middle plank.

17. The decking system as recited in claim 16, further comprising:

a plurality of self-tapping screw means inserted from above said deck substructure into said groove in said rail portion flange of each middle plank for attaching said flange to said substructure, said groove providing an assist in starting penetration of said self-tapping screw means.

18. The decking system as recited in claim 13, wherein said planks include a pair of planks being disposed at opposite outer sides of said deck platform, each outer side plank having a main elongated platform-forming portion with a pair of opposite longitudinal edges thereon, one outer side plank having a plank-supporting runner portion depending adjacent a first said edge of said platform-forming portion and a plank-supporting rail portion depending adjacent a second said edge thereof, the other outer side plank having plank-supporting runner portions depending adjacent both said edges thereof, one outer side plank having a channel portion defined along one of said edges thereof and being matable with said tongue portion of an adjacent one of said middle planks, and the other outer side plank having a tongue portion defined along one of said edges thereof and being matable with said channel portion of an adjacent one of said middle planks.

19. The decking system as recited in claim 13, wherein said rail and runner portions of each middle plank extend in generally orthogonal relation to said platform-forming portion thereof.

20. The decking system as recited in claim 13, wherein said channel portion is disposed between and interconnects one said edge of said platform-forming portion of said planks with said rail portion thereof.

21. A method of assembling a boat comprising the steps of:

constructing a deck substructure mounted to a pair of pontoons;

placing a plurality of deck planks on the deck substructure in side-by-side relation to one another to provide a deck platform upon the deck substructure, said planks including respective flanges extending laterally;

the deck planks being placed on the deck substructure one at a time progressing from one side of the deck substructure to the other side thereof alternately with attachment of each plank to the deck substructure from above the substructure before the next plank is placed thereon, the planks being attached to the deck substructure by fastening the flanges to the substructure from above.

22. The method as recited in claim 21, wherein said step of constructing the deck substructure includes placing and attaching a plurality of cross members on said pontoons in longitudinally spaced relation.

23. A method of assembling a boat decking system, comprising the steps of:

laying out a plurality of cross members in longitudinally spaced relation to provide a deck substructure;

placing a plurality of deck planks on the cross members in side-by-side relation to one another to provide a deck platform upon the deck substructure, said planks including respective flanges extending laterally;

the deck planks being placed one at a time on the cross members progressing from one side of the deck substructure to the other side thereof alternately with attachment of each plank to the cross members from above the deck substructure before the next plank is placed thereon, the planks being attached to the deck substructure by fastening the flanges to the substructure from above; and then attaching the assembled deck platform and substructure to a pair of pontoons.

* * * * *